US005107911A

United States Patent [19]

Plakotaris

[11] Patent Number: 5,107,911

[45] Date of Patent: Apr. 28, 1992

[54] LOG SPLITTING DEVICE

[76] Inventor: Vincent A. Plakotaris, 171 A Hibbler Rd., Hunterdon, N.J. 08833

[21] Appl. No.: 696,224

[22] Filed: May 6, 1991

[51] Int. Cl.[5] ..... B27L 7/00

[52] U.S. Cl. ..... 144/193 R; 144/193 A; 144/193 C; 144/193 D

[58] Field of Search ..... 144/193 R, 193 A, 193 C, 144/193 D, 193 G; 299/23; 173/14, 15, 16, 17, 114, 116, 132

[56] References Cited

U.S. PATENT DOCUMENTS

D. 268,807 5/1983 Reynolds .
D. 269,406 6/1983 Tremaglio .
D. 297,500 9/1988 Kaplan .
4,215,901 8/1980 Langfield et al. ..... 299/23
4,429,727 2/1984 Wilson .
4,646,799 3/1987 Cobb .
4,669,552 6/1987 Foster et al. .
4,673,042 6/1987 Steiner ..... 173/116

*Primary Examiner*—W. Donald Bray
*Attorney, Agent, or Firm*—Kenneth P. Glynn

[57] ABSTRACT

The present invention is directed to a log splitting device. It is, in combination, a manually operated, power jack hammer device with a tool attached thereto having a vertical shaft and the shaft having a log splitting head located thereon. The power jack hammer may be powered numatically, by electric power, or by a small engine. The tool has vertical shaft which is removably held within a tool holder section of the jack hammer. This tool has a log splitting head at one end and the vertical shaft at the other end. The log splitting head is made of solid metal and has a three dimensional maximum set of dimensions, each of which exceed the largest width, or in the case of a cylindrical shaft, diameter, of the vertical shaft.

17 Claims, 3 Drawing Sheets

25
9
11
3
5
7
1
13
23
17
15
19
21
20
28
30

13
15
24
31
20
22
21

LOG SPLITTING DEVICE

BACKGROUND OF THE INVENTION

1. Field of the Invention

This invention relates to a log splitting device which relies upon various aspects of the prior art and offers a novel method for log splitting. The device, more specifically, involves the use of a manually held power jack hammer of the conventional type coupled with unique log splitting attachments which include a solid shaft and a solid log splitting head.

2. Prior Art Statement

The use of fire wood perhaps predates the existence of the use of simple hand tools. As the use of simple hand tools evolved, among other things, they were used for the preparation of fire wood. Eventually, not only was fire wood chopped up, and/or sawed, but larger diameter trees were used and the logs were split. Early log splitting devices included wedge-shaped heads which were pounded into logs using hammers to force the logs to split. Subsequently, ram type shaft, hand powered log splitters came into use. However, for all practical purposes, most people still perform the task with hand tools such as a sledge hammer, maul or other pounding device and a wedge. These wedges take many different shapes, including those with blades and those with points. Eventually, power driven log splitting devices were developed and one involved the use of a giant tapered screw connected to a power source. The screw could attach to the wheel of a vehicle and driven when the wheel was raised above the ground with the log being manually pushed into the screw. Alternative devices included horizontal hydraulic ram type equipment and/or other motor driven ram type log splitters in which the logs were laid on a rack and the splitter was forced to pound into and violently split the logs. Sometimes, these were dangerous due to the magnitude of the force, occasionally causing pieces of the log to fly in all directions. Other types have developed for the purpose of log splitting but none of the type described herein.

U.S. Pat. Nos. Des. 268,807 issued to Michael J. Reynolds, 269,406 issued to Anthony Tremaglio and Philip Kaye and 297,500 issued to Irving Kaplan, all show splitting device or splitting wedge designs which are utilized with a maul or hammer to split logs. These require accurate locating and holding of the wedge to get started, accurate hammering and very forceful hammering for the wedge to be successful, along with the risk of having the wedge fly at the user upon impact, having the hammer or maul misstrike the wedge and ricochet in the direction of the user and requiring very, very substantial muscular power to split many of the desirable hard wood logs into fire wood. Additionally, these devices require the user to have their own means or mechanism for holding the log in place during striking. While this is not generally a problem, the rotation of the log due to the impacts for the hammer or maul not hitting the wedge squarely add another safety problem.

In place of the manual hammer and wedge type of log splitting device, there developed a manual log splitter utilizing a shaft and handle whereby human downward force on a movable section of the device would cause human powered impact of a wedge head to eventually split a log. Thus, U.S. Pat. Nos. 4,429,727 issued to Robert C. Wilson and Des. 269,406 issued to Anthony Tremaglio and Philip Kaye describes such devices. The Tremaglio requires hands to be wrapped around a hollow cylinder and with the palms of the hands vertical, the upward and downward motion to cause the wedge to penetrate and split a log. On the other hand, the Wilson device has handles which are horizontal and the user moves a shaft up and down with an impact block inside a housing by lifting up and pushing down on the handles. In order to alleviate the brut force requirements of these types of prior art devices, there evolved devices which were similar but, instead of using human downward force, utilizes force from a gun powder or similar firing. Thus, U.S. Pat. No. 4,646,799 describes a wood splitting device using the vertical impact of a wedge and shaft located in an outer shaft. However, the power source involves the use of an explosive cap placed in the top housing and screwed in so that the force of the explosion pushes downwardly on the shaft. The difficulty with this prior art involves the serious safety concerns of using an explosive, the problem of the device firing the outer shaft upward to some extent when firing the shaft with the wedge downwardly, as well as problems of holding the device in place during explosion or, in the alternative, relying upon a wedge which is partially set into a log, still requiring brut force and all the safety problems mentioned above. Thus, this last device seems to eliminate the use of pure human power but create very substantial safety in doing so.

As mentioned above, the alternative type of log splitting devices are typically rotational screw type devices or ram type devices which act in a horizontal plane and require substantial set up as well as cost, without eliminating the problems of acute force causing log shattering.

The only prior art which seems to have developed along the lines of a manually operated but power driven device which does not utilize explosives and which does not require the substantial set up of the ram type devices or the screw type devices, is a power driven apparatus described in U.S. Pat. No. 4,669,552. This device involves a power driving apparatus which has horizontal handles and a power source for creating reciprocal motion, as well as a log splitting head which enables the user to hold the device as shown in the figures, in a vertical position with the reciprocal impacting of a log splitting head downwardly on a log. While this prior art seems to be a substantial improvement over the above mentioned prior art, it has short comings in that the device does not have the versatility of a jack hammer and, more significantly utilizes a complex tie-in mechanism for the reciprocal power. It does not allow for interchangability with conventional jack hammer heads and even requires a hollow head with a spring type hook attachment to the inside of the hollow head. On the other hand, the present invention is directed to a log splitting device using a jack hammer with a removable shaft and head whereby the device may be used for all operations which are typically available to a jack hammer owner, simply by substituting the shaft and head, and, could not have the durability or weight in the head itself utilizing a hollow head device. Finally, the complexity of the attachment of the head to the device leaves much to be desired in terms of ease of operation.

Thus, not withstanding formidable prior art in this field, there seems to be no prior art which anticipates or renders obvious the present invention utilizing a power jack hammer in conjunction with interchangable shafts having log splitting, solid metal heads.

SUMMARY OF THE INVENTION

The present invention is directed to a log splitting device. It is, in combination, a manually operated, power jack hammer device with a tool attached thereto having a vertical shaft and the shaft having a log splitting head located thereon. The power jack hammer may be powered numatically, by electric power, or by a small engine. The tool has a vertical shaft which is removably held within a tool holder section of the jack hammer. This tool has a log splitting head at one end and the vertical shaft at the other end. The log splitting head is made of solid metal and has a three dimensional maximum set of dimensions, each of which exceed the largest width, or in the case of a cylindrical shaft, diameter, of the vertical shaft.

BRIEF DESCRIPTION OF THE DRAWINGS

The present invention will be more fully understood when the specification set forth herein is taken in conjunction with the drawings appended hereto, wherein.

DETAILED DESCRIPTION OF THE INVENTION AND DRAWINGS

Jack hammers have been available for a number of decades and provide many different uses. For example, the jack hammer typically is used to break up concrete or macadam for repairs or replacement and maybe powered by numatics, by gasoline or other reciprocating engine, or by electric power. Besides the typical chisel type head tools which are available to the jack hammer operator, there are blade type tools such as the bull point (a split or bent point), a narrow chisel which has a blade width equal to the width of the shaft, a widened chisel, a super cut chisel which is a chisel having a cross type blade and others. In addition, tools attachable to a jack hammer which are commercially available include asphalt cutter blades, clay spades, frost wedges, digging chisels and tampering plates. More recently, tools include drivers which are much like lug wrenches and have hollow heads such as spike and pin drivers and ground rod drivers. The present invention, however, is directed to the combination of conventional jack hammers having interchangable tools, with tools heretofore unknown which are specifically adapted for log splitting purposes.

Figure 1:
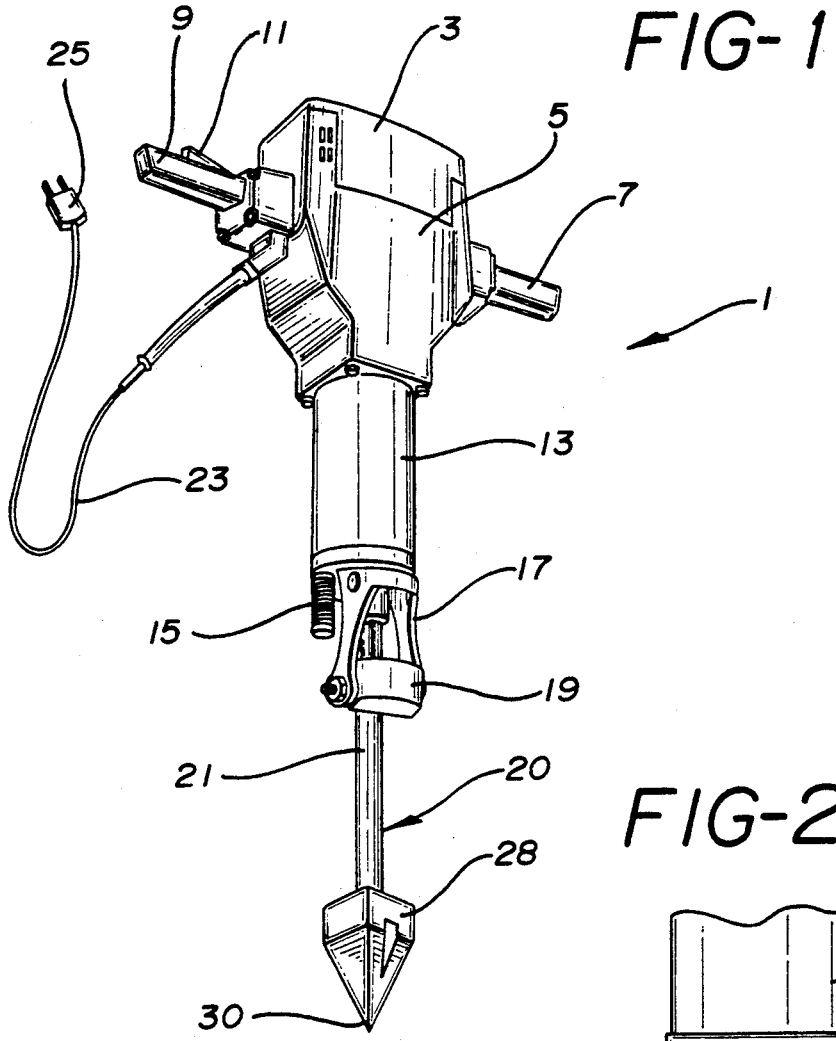
FIG. 1 shows an oblique frontal view of a present invention device.

Referring now to FIG. 1 there is shown present invention log splitting device 1 having a top portion 3 with a housing 5 containing a drive mechanism (not shown), handles 7 and 9 and control 11. Reciprocating mechanism housing 13 and springs or shocks 15 are also shown. In this embodiment, the present invention log splitting device is electrically powered, hence cord 23 and plug 25. Guide mechanism 17 with roller 19 aides in maintaining the tool in its proper position and also absorbs lateral vibration to some extent. Tool 20 includes shaft 20 and head 28 which is tapered to point 30. Log splitting head 28 is made of solid metal as is shaft 21 to provide for maximum durability and maximum concentration of pounds of force impacting during the log splitting process. Log splitting head 28 is merely typical and any one of a variety of log splitting heads could be provided therewith as long as it meets the other criteria set forth herein.

Figure 2:
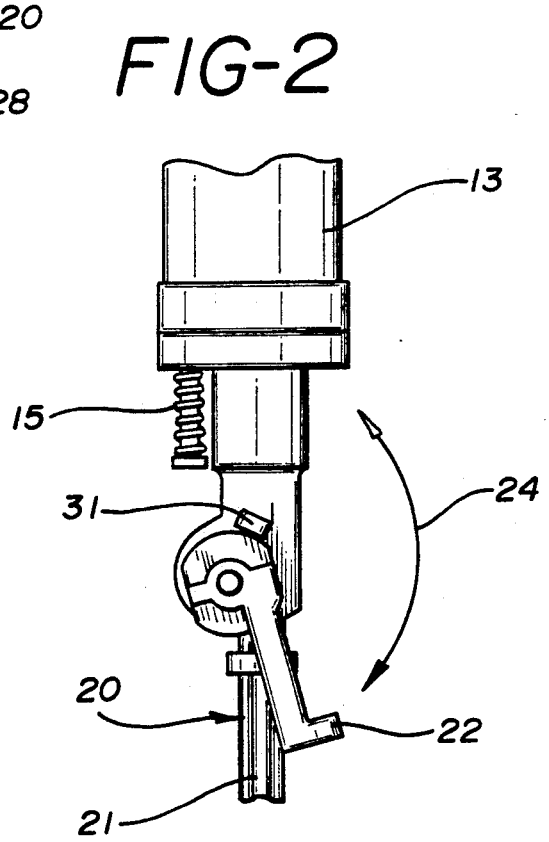
FIG. 2 shows a side partial view of a present invention device, illustrating a typical attachment mechanism.

A user operating log splitting device 1 would attach tool 20 in any conventional manner such as is illustrated by FIG. 2, wherein like parts from FIG. 1 are like numbered. Retainer 22 may or may not take the form of roller 19 and a latch such as latch 31 is used to lock retainer 22 in place once it is in the appropriate position. As shown by arrow 24, retainer 22 rotates upwardly and downwardly for removal of tool 20.

Figure 3:
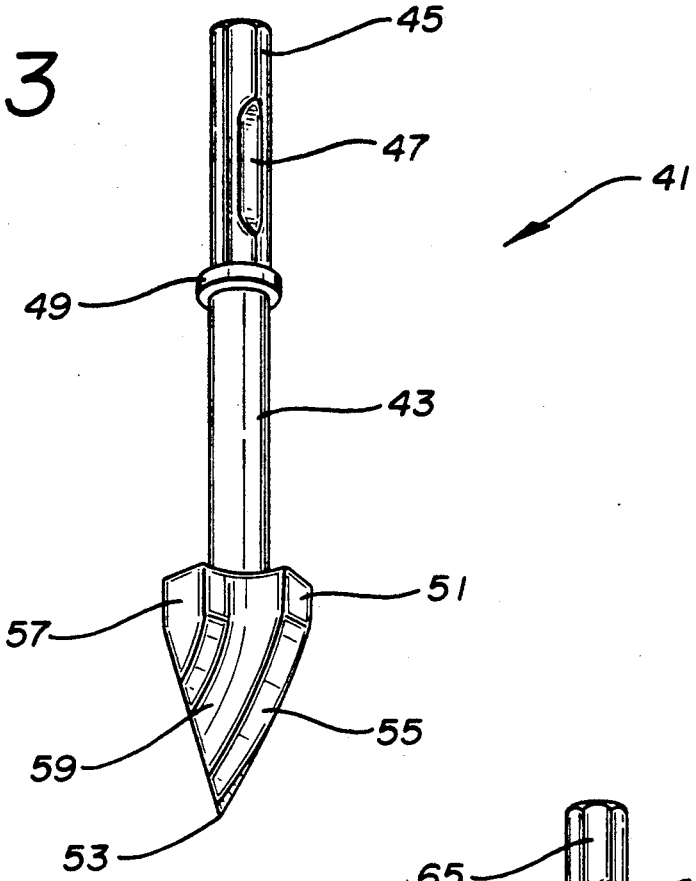
FIG. 3 shows a front view of one type of log splitting tool which is used in the present invention device.

FIG. 3 shows a log splitting tool utilized in the device of the present invention which is different from that shown in FIG. 1. More specifically, log splitting tool 41 includes shaft 43, shaft stop 49, top end 45 and tool locking recess 47. When tool 41 is put into a jack hammer, it may be locked in by any known mechanism which would grasp recess 47. Tool 41 also includes head 59 with raised shoulder 51 and 57 and angled recesses 55 coming to a point 53. This type of tool 41 has a head which is somewhat similar to head 28 shown in FIG. 1 except that it has what amount to twisted recesses. As an additional feature to this particular embodiment, as head 59 penetrates a log, it rotates due to the twisted recesses. Thus, a user will be able to judge the extent of penetration of the log by the extent of rotation of the tool head.

Figure 4:
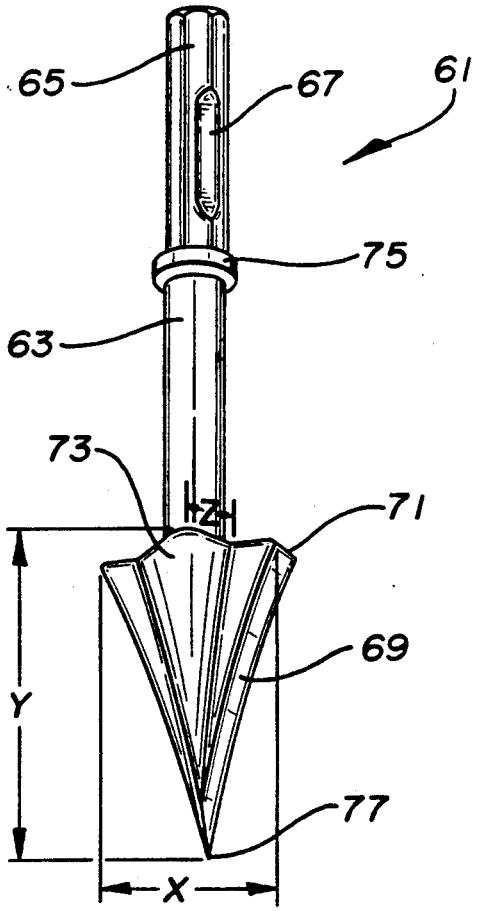
FIG. 4 shows a front view of an alternative log splitting tool used in a present invention device and including the three dimensional aspects of the log splitting head.

Referring now to FIG. 4, this front view of tool 61 shows shaft 63 with stop 75, top 65 and attaching recess 67. In this case, head 69 includes wide shoulder 71, rounded shoulder 73 and tip 77. Again, tool head 69 is made of solid metal. Furthermore, its cross section in all three dimensions, that is the x dimension, the y dimension and the z dimension as shown in the figure, exceed the diameter of shaft 63. This provides for substantial solid mass to enable effective, accurate and relatively quick splitting of a log without the user having to align a hammer or maul and wedge and without having to use brut force to pound in a log splitter. The aspect of the three dimensions being all greater than the width of the shaft or widest dimension of a non-cylindrical shaft, is an important feature of the present invention.

Figure 5:
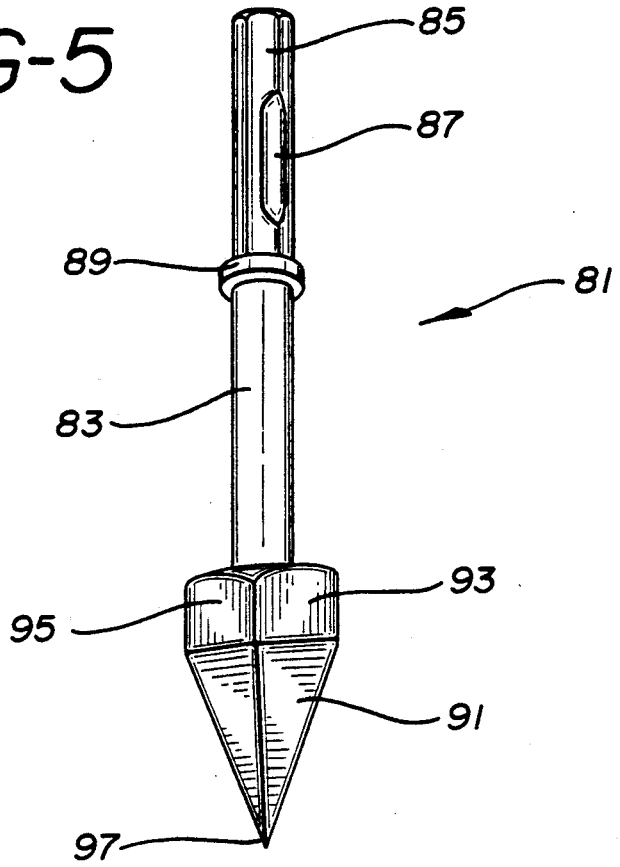
FIG. 5 shows a front view of yet another alternative log splitting tool used in a device of the present invention; and, FIG. 6 shows a front view of another log splitting tool used in the device of the present invention.

FIG. 5 shows another log splitting tool 81 of the present invention. This includes shaft 83, stop 89, top 85 and attachment recess 87. Log splitting tool head 91 has flat, wide head dimensions 93 and 95, tapering geometrically to a point 97.

Figure 6:
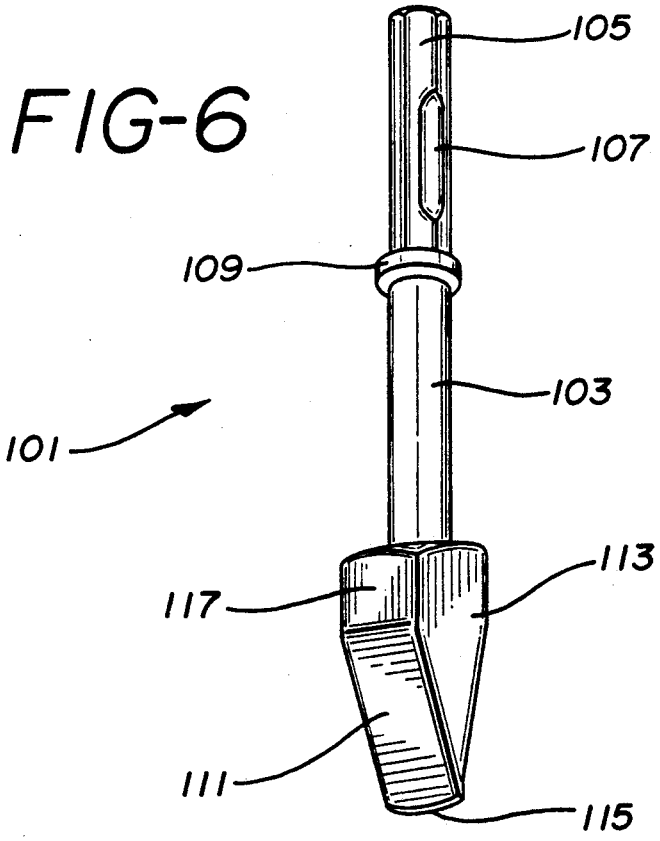

FIG. 6 shows yet again another embodiment of the present invention wherein tool 101 includes shaft 103, top 105, recess 107, stop 109 and log splitting tool head 111. Head 111 includes a flat side 113 and a double angled side comprising facets 117 and its lower portion which all combine to taper into a blade 115, as shown.

It should be noted that the tool attached to the device of the present invention necessarily is solid and has dimensions greater than the shaft dimension and may taper into a single point, a flat blade, a series of points, a series of blades intersecting or any other arrangement which would aid in splitting the typical hard wood log utilizing a present invention log splitting device. Further, these are typically made of hardened steel and any useful alloy may be employed. Finally, the exact mechanism of the reciprocating function of the jack hammer portion of the present invention device is well within the ability of one of ordinary skill in the art and the particular operations and internal aspects are, therefore, not included in detail herein.

Obviously, numerous modifications and variations of the present invention are possible in light of the above teachings. It is therefore understood that within the scope of the appended claims, the invention may be practiced otherwise than as specifically described herein.

What is claimed is:

1. A log splitting device comprising, in combination:

(a) a manually operated independently powered jack hammer having at least vertical vibrational motion and having a tool holder adapted to receive a tool having a vertical shaft; and, (b) a tool having a vertical shaft removably held within said tool holder, said tool being a log splitting tool having a first end at least terminating in a shaft and having a second end being opposite said first end and terminating in a log splitting head, wherein said shaft has a maximum cross-sectional dimension and said log splitting head has x-axis, y-axis, and z-axis dimensions all of greater size than the maximum cross-sectional dimension of said shaft.

2. The log splitting device of claim 1 wherein said shaft has a maximum cross-sectional dimension and said log splitting head has x-axis, y-axis, and z-axis dimensions all of greater size than the maximum cross-sectional dimension of said shaft.

3. The log splitting device of claim 1 wherein said log splitting head is a solid metal generally conical in shape.

4. The log splitting device of claim 1 wherein said log splitting head is a solid metal which is generally wedge-shaped.

5. The log splitting device of claim 1 wherein said log splitting head is a solid metal having a generally criss-crossed head.

6. The log splitting device of claim 1 wherein said log splitting head is a solid metal generally spear-headed.

7. The log splitting device of claim 1 wherein said log splitting head is a solid metal tapering to a point.

8. The log splitting device of claim 1 wherein said log splitting head is a solid metal tapering to a flat blade.

9. The log splitting device of claim 1 wherein said log splitting head is a solid metal generally tapered to a point with varying, irregular cross sections.

10. The log splitting device of claim 1 wherein said power jack hammer device is an electrically operated jack hammer.

11. The log splitting device of claim 10 wherein said log splitting head is a solid metal generally conical in shape.

12. The log splitting device of claim 10 wherein said log splitting head is a solid metal which is generally wedge-shaped.

13. The log splitting device of claim 10 wherein said log splitting head is a solid metal having a generally criss-crossed head.

14. The log splitting device of claim 10 wherein said log splitting head is a solid metal generally spear-headed.

15. The log splitting device of claim 10 wherein said log splitting head is a solid metal tapering to a point.

16. The log splitting device of claim 10 wherein said log splitting head is a solid metal tapering to a flat blade.

17. The log splitting device of claim 10 wherein said log splitting head is a solid metal generally tapered to a point with varying, irregular cross sections.

* * * * *